US007461742B2

(12) United States Patent
Or et al.

(10) Patent No.: US 7,461,742 B2
(45) Date of Patent: Dec. 9, 2008

(54) PACKAGE FOR A PORTABLE USB STORAGE DEVICE

(75) Inventors: Ori Or, Tel Aviv (IL); Bill Zani, Alpharetta, GA (US)

(73) Assignee: SanDisk iL, Ltd., Kfar Saba (IL)

( * ) Notice: Subject to any disclaimer, the term of this patent is extended or adjusted under 35 U.S.C. 154(b) by 189 days.

(21) Appl. No.: 11/482,728

(22) Filed: Jul. 10, 2006

(65) Prior Publication Data

US 2007/0163913 A1 Jul. 19, 2007

Related U.S. Application Data

(60) Provisional application No. 60/759,398, filed on Jan. 18, 2006.

(51) Int. Cl.
*B65D 73/00* (2006.01)
*B65D 85/00* (2006.01)

(52) U.S. Cl. ..... 206/463; 206/701; 206/718; 206/806

(58) Field of Classification Search ..... 206/461–463, 206/469.486–490, 701, 703–705, 713, 716, 206/718, 722, 726–728, 806, 305, 320
See application file for complete search history.

(56) References Cited

U.S. PATENT DOCUMENTS

| | | | | | |
|---|---|---|---|---|---|
| 1,816,542 | A * | 7/1931 | Mellin | 206/463 |
| 2,604,204 | A * | 7/1952 | Rockey et al. | 206/806 |
| 2,645,339 | A * | 7/1953 | Toy | 206/486 |
| 3,198,329 | A * | 8/1965 | Golenpaul et al. | 206/486 |
| 3,322,268 | A * | 5/1967 | Larkin | 206/488 |
| 3,856,144 | A * | 12/1974 | Kelly | 206/462 |
| 4,061,229 | A * | 12/1977 | Ohtsuka | 206/486 |
| 6,076,675 | A * | 6/2000 | Pawlowski | 206/463 |
| 6,439,390 | B1 * | 8/2002 | Kumakura et al. | 206/705 |
| 7,255,230 | B1 * | 8/2007 | Appelbaum | 206/463 |
| 2006/0278539 | A1 * | 12/2006 | Fager | 206/463 |

* cited by examiner

*Primary Examiner*—Bryon P Gehman
(74) *Attorney, Agent, or Firm*—Mark M. Friedman

(57) ABSTRACT

The present invention discloses systems and methods for packaging multiple articles of manufacture for display at a point of sale. The packaging allows the articles of manufacture to be grasped and felt by a consumer prior to purchase, while reducing the chance of unintended or illegal removal of the articles of manufacture from the packaging. The packaging also allows the articles of manufacture to be connected to a host device and tested prior to purchase without damaging the packaging. The articles of manufacture can be made of multiple components which can be attached to the packaging during the assembly of the components.

13 Claims, 4 Drawing Sheets

PACKAGE FOR A PORTABLE USB STORAGE DEVICE

This patent application claims the benefit of U.S. Provisional Patent Application No. 60/759,398 filed Jan. 18, 2006.

FIELD AND BACKGROUND OF THE INVENTION

The present invention relates to systems and methods for packaging portable USB storage devices. Portable USB storage devices, such as USB flash disks (or UFDs), are well-known in the art of digital computing, and are offered by many vendors. A typical example of such a USB storage device is a DiskOnKey™ portable memory available from M-Systems Inc. of Kefar Saba, Israel.

As the popularity of UFD devices increases and their prices decrease, there is a commercial need to price, package, and display them as mass-consumer products. One of the common methods of merchandising a mass-consumer product is to display it in an attractive package near the point of sale in appropriate retail stores. In the case of a UFD, typical retail stores include electronic stores, media stores, and department stores.

Since UFDs are intended to be carried by a person (typically in a pocket), and plugged into computers and other devices by hand, the consumer would appreciate the ability to "touch and feel" the body of the device prior to purchasing it as a part of his/her impulsive purchase behavior. Enabling the consumer to hold the UFD device for evaluation is a feature that is important in the promotion of selling the product at points of sale.

However, as the typical UFD device is small, and even a low-price UFD costs several dollars, it is risky for the store to place UFD devices near points of sale where a shoplifter can easily take the UFDs, and slide them into a pocket without paying for them. In order to prevent such theft, many expensive compact electronic devices are displayed in stores with a strong leash that connects them to the display stand. Such a solution is not feasible for UFDs because the number of units on display is typically too large to tie each unit to a leash.

Packaging a set of UFDs in a closed package would be secure, but denies the consumer the ability to touch and feel the device. Connecting each UFD individually to an open package would reduce the consumer's inclination to buy a package of multiple devices in a single purchase, and would be counterproductive to the sales effort.

It would be desirable to have a method of packaging a plurality of UFD devices in such a way that they would be considered by the consumer as a single package, reducing the likelihood of shoplifting, and yet will still allow the consumer to hold the UFD in a "touch and feel" manner. It would be further desirable to also permit the packaged UFD to be plugged into a computer to verify that it works properly, in case the consumer insists on testing the device before purchasing it.

SUMMARY OF THE INVENTION

For the purpose of clarity, several terms which follow are specifically defined for use within the context of this application. The term "UFD" is used in this application to refer to a USB flash disk. The term "equator" is used in this application to refer to the largest contour around a generally convex device, typically dividing the volume of the device into similar upper and lower halves. The term "substantially rigid" is used in this application to refer to a material that maintains its shape, but can be reversibly bent when force is applied.

The term "functionally configured" is used in this application to refer to a design element that is specially made for the purpose of packaging a device, and does not serve any other functional purpose. The term "inhibits" is used in this application to refer to making removal of a UFD too hard for a shoplifter to get the UFD out without being caught, but not so hard that a consumer can't remove the UFD after purchase. The term "unintended removal" is used in this application to refer to removal that occurs in a manner not intended by the manufacturer.

It is the purpose of the present invention to provide systems and methods for packaging one or more UFDs in a way that meets the objectives described above. The UFD of the present invention has a groove, composed of a set of one ore more recessions (or notches), along the equator of the UFD. These notches, which do not interfere with the typical areas of contact between the hand and the UFD, are used to hold in place a flat hard sheet, typically made of cardboard or plastic, which leaves essentially half of the width of the UFD exposed on each side of the sheet. The sheet typically is small enough to allow the consumer to easily grab both sides of the UFD with one hand. The consumer can touch, hold, and feel the UFD without interference of the sheet.

The sheet serves as an open package for the UFD. The sheet can be opaque or clear, and carry printed text and graphics between and around the opening that supports the UFD. Perforation lines between individual segments of the sheet allow a single package to be torn into smaller sections, in case the consumer wants to buy a smaller number of units, and not the full package. An aperture at the top of the sheet serves to hang the package at a point of sale.

The penetration of the sheet's tabs into the body of the UFD can be made deep enough so that pulling the UFD out of the sheet would require a substantial degree of force, necessitating the use of both hands. This feature further reduces the risk of unintended or illegal removal of a product from the package. Altogether, the present invention teaches a very effective method for packaging low-cost UFDs, serving the needs for security, aesthetic appeal, and functionality of the product.

Therefore, according to the present invention, there is provided for the first time a packaging system including: (a) at least one article of manufacture; and (b) a substantially-rigid and planar sheet; wherein each article of manufacture is functionally configured to be supported by the sheet within a respective aperture of the sheet.

Preferably, the functional configuration of each article of manufacture includes providing each article of manufacture with a periphery functionally configured to interact with the sheet in a manner that inhibits unintended removal of each article of manufacture from the sheet.

Preferably, the sheet includes an aperture for hanging at least one article of manufacture on a display rack.

Preferably, the system comprises two articles of manufacture, and the sheet includes at least one perforation line between the two articles of manufacture.

Preferably, at least one article of manufacture is a hand-held electronic device.

More preferably, the hand-held electronic device is a memory device.

Most preferably, the memory device is a UFD.

Preferably, each article of manufacture includes two components configured to be assembled in a manner that sandwiches at least a portion of the sheet, adjacent to the respective aperture of the sheet, between the two components, thereby supporting each article of manufacture by the sheet.

Preferably, each article of manufacture includes a connector for plugging into a socket of a host device.

Most preferably, the sheet is configured to be reversibly bent in order to expose the connector, thereby allowing the connector to be plugged into the socket.

There is provided for the first time a method of displaying at least one article of manufacture being offered for sale, the method including the steps of: (a) providing a substantially-rigid and planar sheet for supporting each at least one article of manufacture within a respective aperture of the sheet; (b) functionally configuring each at least one article of manufacture to be supported by the sheet within the respective aperture; and (c) inserting each at least one article of manufacture into the respective aperture so as to be supported by the sheet, thereby preparing the at least one article of manufacture to be displayed for sale.

Preferably, the step of inserting is: effected, for each article of manufacture, by assembling at least two components of the each article of manufacture.

Preferably, the step of functionally configuring is effected by functionally configuring a periphery of each article of manufacture to interact with the sheet in a manner that inhibits unintended removal of the each article of manufacture from the sheet.

Preferably, the method further includes the steps of: (d) configuring the sheet to be reversibly bendable in order to expose a connector of each article of manufacture for plugging each article of manufacture into a socket of a host device.

Preferably, the method further includes the steps of: (d) configuring an aperture in the sheet for hanging the sheet along with the at least one article of manufacture on a display rack.

There is provided for the first time a method of displaying two articles of manufacture being offered for sale, the method including the steps of: (a) providing a substantially-rigid and planar sheet for supporting each article of manufacture within a respective aperture of the sheet; (b) functionally configuring each article of manufacture to be supported by the sheet within the respective aperture; (c) inserting each article of manufacture into the respective aperture so as to be supported by the sheet; and (d) providing at least one perforation line in the sheet separating the two articles of manufacture, thereby preparing the two articles of manufacture to be displayed for sale.

These and further embodiments will be apparent from the detailed description and examples that follow.

BRIEF DESCRIPTION OF THE DRAWINGS

The present invention is herein described, by way of example only, with reference to the accompanying drawings, wherein.

DESCRIPTION OF THE PREFERRED EMBODIMENTS

The present invention relates to systems and methods for packaging portable USB storage devices. The principles and operation for packaging portable USB storage devices, according to the present invention, may be better understood with reference to the accompanying description and the drawings.

Figure 1:
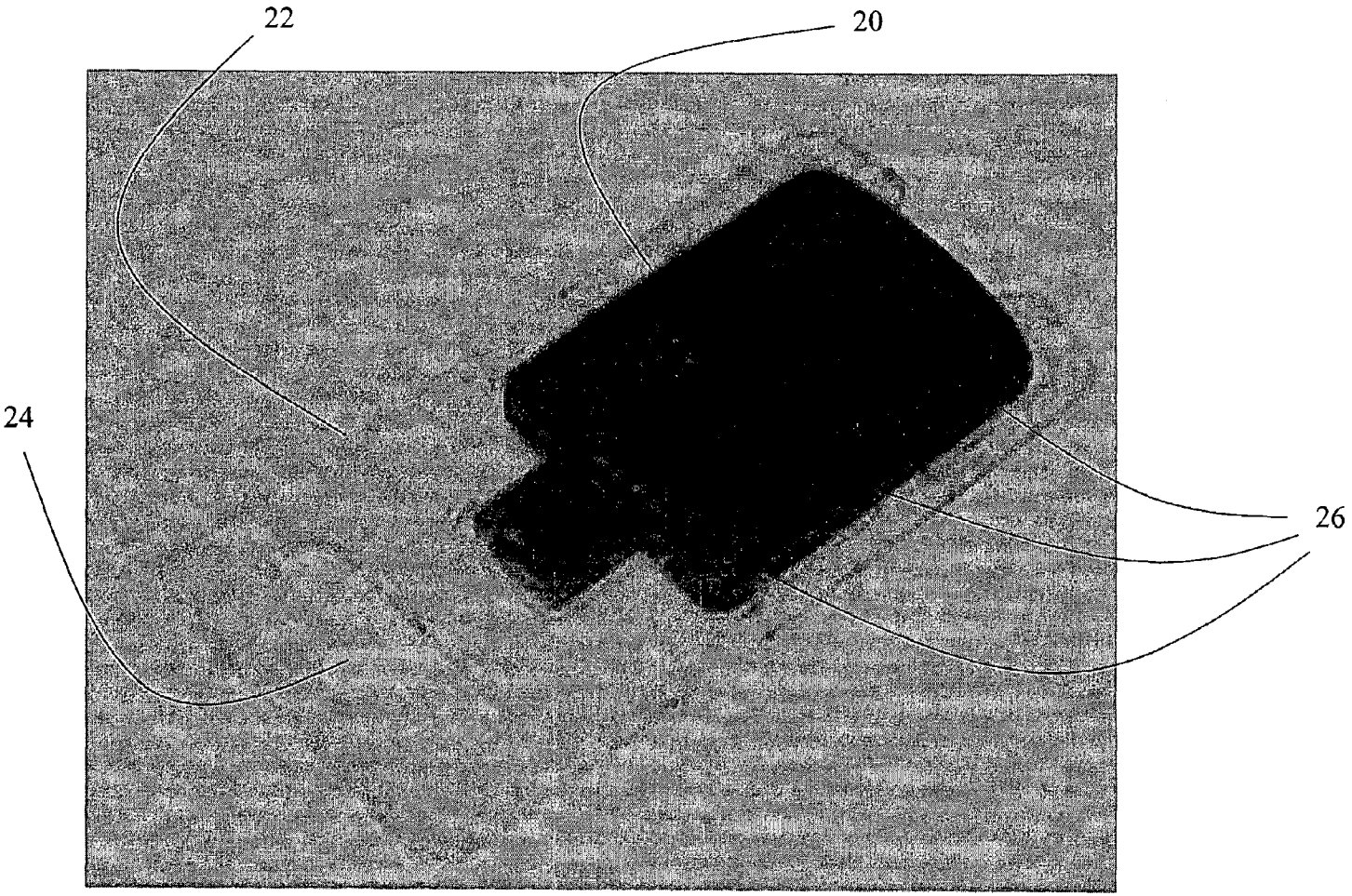
FIG. 1 is a photograph of a single, packaged UFD, according to the present invention.

Referring now to the drawings, FIG. 1 is a photograph of a single, packaged UFD, according to the present invention. A single UFD 20 is shown packaged in a clear plastic sheet package 22. A mounting aperture 24 in sheet package 22 provides the ability to hang sheet package 22 in a display location. There are notches 26 in the equator of UFD 20. Sheet tabs, located along the inner periphery of sheet package 22, fit, in a "tongue and groove" manner, into notches 26. A clearer view of notches 26 (and their corresponding sheet tabs) is provided in the following drawings.

Figure 2:
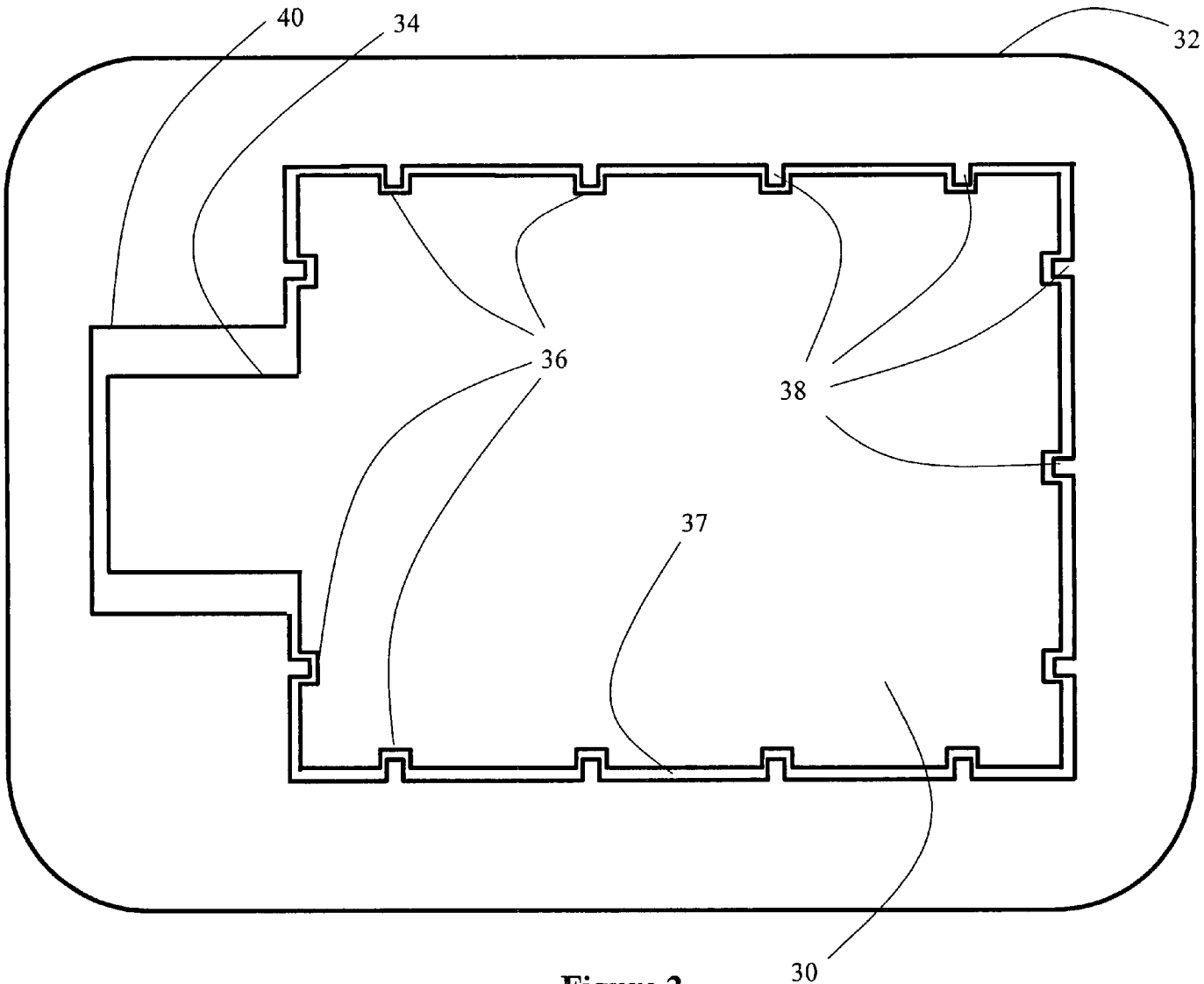
FIG. 2 is a schematic cross-sectional view along the equator of a single, packaged UFD, according to the present invention.

FIG. 2 is a schematic cross-sectional view along the equator of a single, packaged UFD, according the present invention. A UFD 30 packaged in a sheet package 32 is shown. An equator 34 of UFD 30 is shown in FIG. 2 as the outer contour of UFD 30, with notches 36 along equator 34. Sheet package 32 has an inner periphery gap 37 to accommodate UFD 30 with a slight margin of typically 1-3 mm to allow insertion and extraction of UFD 30 from sheet package 32. However, extraction of UFD 30 from sheet package 32 requires an individual to use both of his/her hands to remove UFD 30, reducing the chance of theft. Sheet tabs 38 are designed and positioned along an inner periphery 40 of sheet package 32 in a manner that allows physical engagement with notches 36. UFD 30 is secured in sheet package 32 during assembly, when upper and lower halves (not shown) of UFD 30 are connected to each other while notches 36 of UFD 30 are aligned with sheet tabs 38 of sheet package 32.

The height of each notch 36 (i.e. in the direction perpendicular to the plane of the drawing) is typically a few tenths of a millimeter larger than the thickness of sheet package 32. The length and width of sheet tabs 38 (i.e. in the direction parallel to the plane of the drawing) are typically slightly smaller than the corresponding dimensions of notches 36, allowing UFD 30 to move slightly about its position, but preventing UFD 30 from being extracted from its position without bending or tearing sheet package 32. Since sheet package 32 can be made of a tough material, the designer of sheet package 32 can make it hard or easy to extract UFD 30. Preferably, as mentioned above, extraction of UFD 30 from sheet package 32 requires sheet package 32 and UFD 30 to be held firmly in both hands, reducing the chance of unintended or illegal separation of the two components.

Figure 3A:
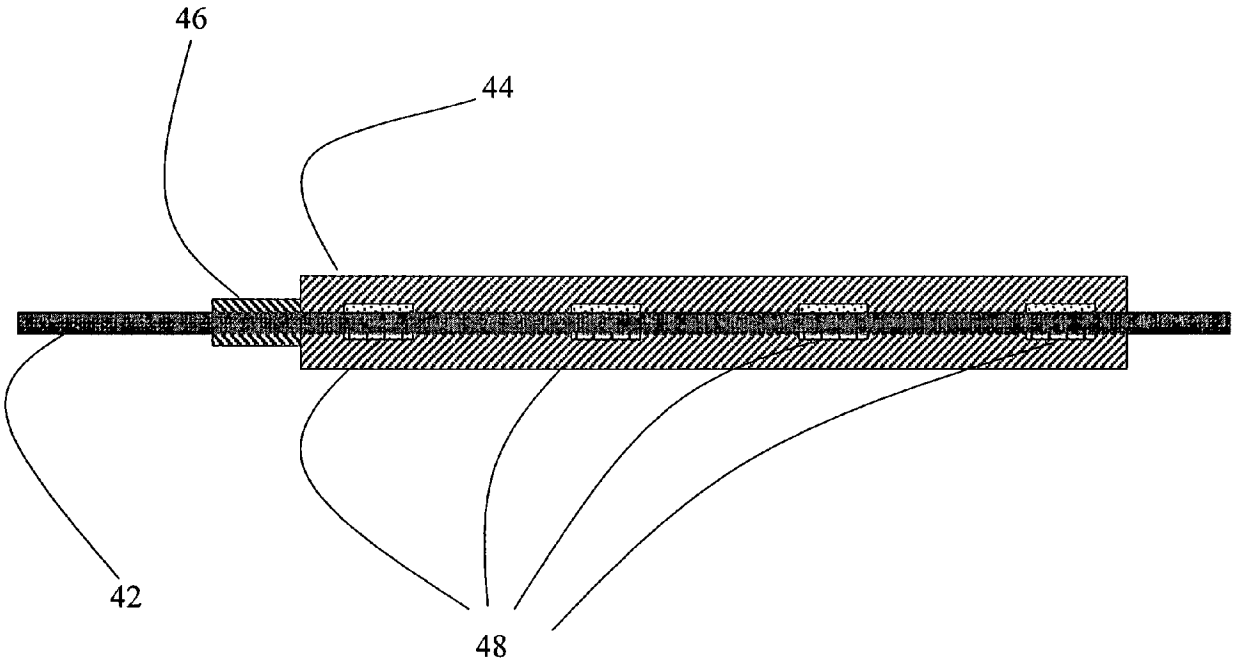
FIG. 3A is a schematic side view of a UFD package, according to the present invention.

FIG. 3A is a schematic side view of a UFD package, according to the present invention. A sheet package 42 holds a UFD 44, with a USB connector 46, as described above in relation to FIG. 2. Notches 48 in the periphery of UFD 44 (typically, in the three sides that do not contain USB connector 46) are partially visible as the height of notches 48 is slightly greater than the thickness of sheet package 42.

Figure 3B:
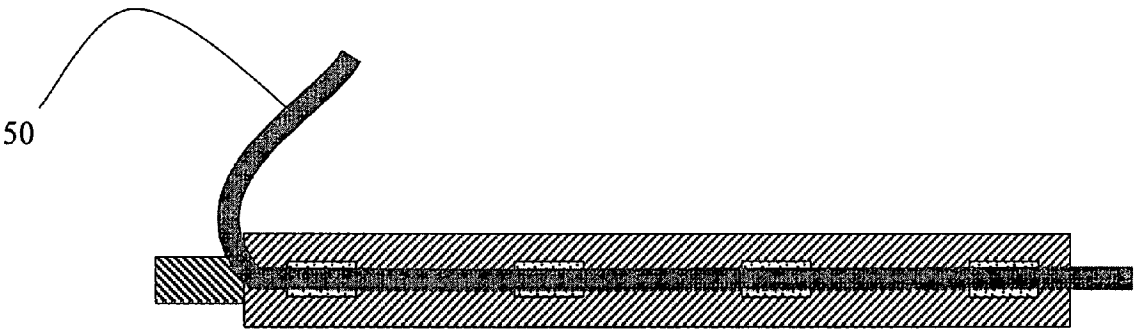
FIG. 3B is a side view of the UFD package of FIG. 3A with one end of the sheet package bent upward.

Since there are no notches in the side of UFD 44 containing USB connector 46, sheet package 42 is designed to bend around USB connector 46, enabling USB connector 46 to be plugged into a USB socket (not shown), either on a cable or in a device, for testing UFD 44 without damaging the integrity of sheet package 42. FIG. 3B is a schematic side view of the UFD package shown in FIG. 3A with one end of the sheet package bent upward. A connector end 50 of sheet package 42 is folded upwards to expose USB connector 46 for plugging USB connector 46 into a USB socket (not shown).

Figure 4:
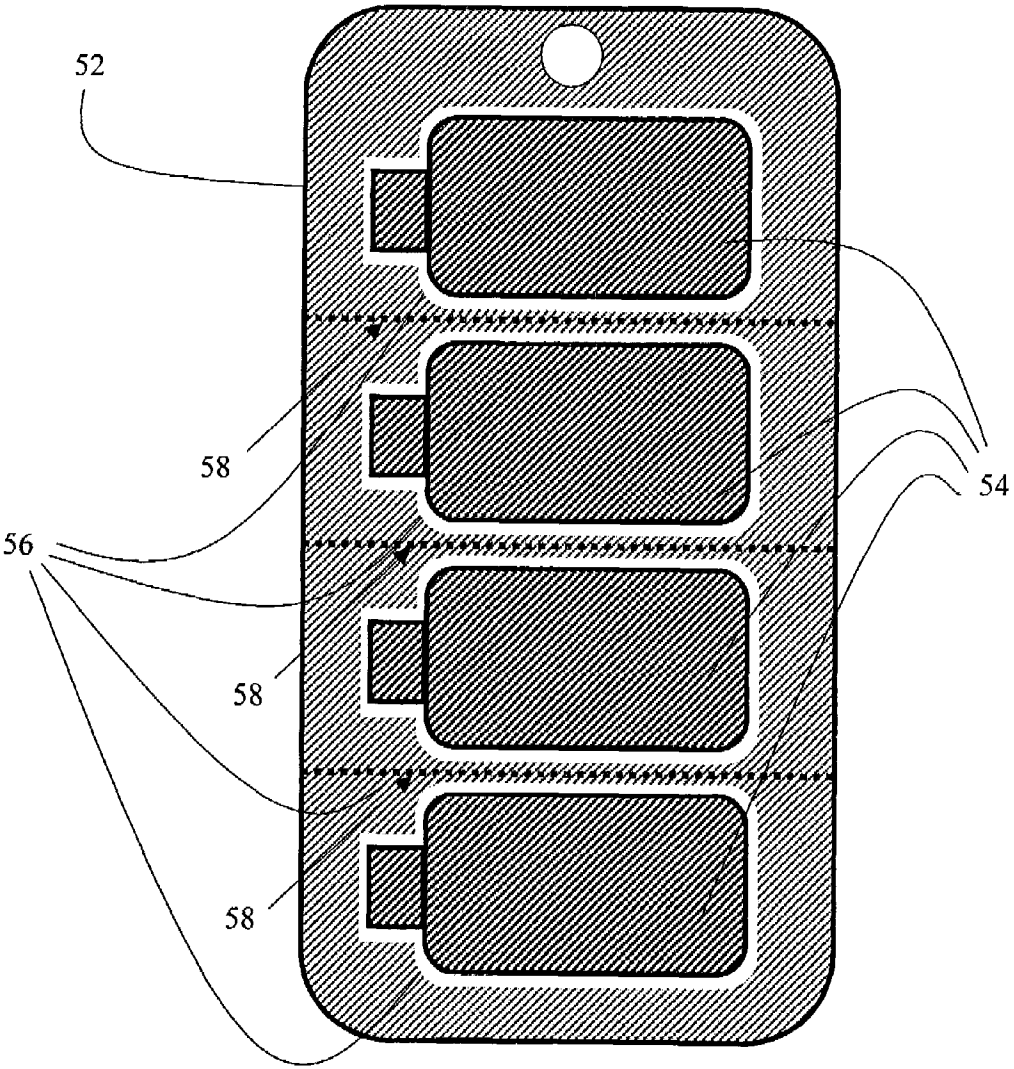
FIG. 4 is a schematic top view of a package containing four UFDs, according to the present invention.

FIG. 4 is a schematic top view of a package containing four UFDs, according to the present invention. A sheet package 52 holds four UFDs 54 that are held in sheet openings 56 by sheet tabs and notches (not shown) as described above. Perforation lines 58 enable a consumer to tear off as many UFDs 44 as desired from sheet package 52.

While the invention has been described with respect to a limited number of embodiments, it will be appreciated that many variations, modifications, and other applications of the invention may be made.

What is claimed is:

1. A packaging system comprising:

(a) a hand-held electronic device that includes two components; and (b) a substantially-rigid and planar sheet having an aperture;

wherein said two components have at least a portion of said sheet, adjacent to said aperture, sandwiched therebetween so as to support said hand-held electronic device by said sheet.

2. The system of claim 1, wherein said hand-held electronic device is provided with a periphery functionally configured to interact with said sheet in a manner that inhibits unintended removal of said hand-held electronic device from said sheet.

3. The system of claim 1, wherein said sheet includes an aperture for hanging said hand-held electronic device on a display rack.

4. The system of claim 1, wherein the system further comprises an additional hand-held electronic device that includes an additional two components, and said sheet includes at least one perforation line between said hand-held electronic device and said additional hand-held electronic device.

5. The system of claim 1, wherein said hand-held electronic device is a memory device.

6. The system of claim 5, wherein said memory device is a UFD.

7. The system of claim 1, wherein said hand-held electronic device includes a connector for plugging into a socket of a host device.

8. A packaging system comprising:

(a) an article of manufacture including a connector for plugging said article of manufacture into a host device; and (b) a substantially planar sheet that is secured to a portion of said article of manufacture so as to support said article of manufacture within an aperture of said planar sheet with said connector at least partly concealed in a manner that prevents plugging said article of manufacture into a host device, said portion of said article of manufacture being exclusive of said connector, thereby allowing said planar sheet to be bent to expose said connector to plug said article of manufacture into a host device.

9. A method for displaying a hand-held electronic device being offered for sale, the method comprising the steps of:

(a) providing a substantially-rigid and planar sheet for supporting the hand-held electronic device within an aperture of said sheet;

(b) functionally configuring the hand-held electronic device to be supported by said sheet within said aperture, wherein the hand-held electronic device includes two components that have at least a portion of said sheet, adjacent to said aperture, sandwiched therebetween so as to support the hand-held electronic device by said sheet; and (c) inserting the hand-held electronic device into said aperture, by assembling said two components so as to be supported by said sheet, thereby preparing the hand-held electronic device to be displayed for sale.

10. The method of claim 9, wherein said step of functionally configuring is effected by functionally configuring a periphery of the hand-held electronic device to interact with said sheet in a manner that inhibits unintended removal of the hand-held electronic device from said sheet.

11. The method of claim 9, the method further comprising the steps of:

(d) configuring an aperture in said sheet for hanging the sheet along with the hand-held electronic device on a display rack.

12. A method for displaying an article of manufacture being offered for sale, the method comprising the steps of:

(a) providing a substantially-rigid and planar sheet that is secured to a portion of the article of manufacture for supporting the article of manufacture within an aperture of said sheet, wherein the article of manufacture includes a connector, for plugging the article of manufacture into a host device, said connector being at least partly concealed by said sheet in a manner that prevents plugging said article of manufacture into a host device, and wherein said portion of the article of manufacture is exclusive of said connector, thereby allowing said planar sheet to be bent to expose said connector to plug the article of manufacture into a host device;

(b) functionally configuring the article of manufacture to be supported by said sheet within said aperture, wherein the article of manufacture includes two components that have at least a portion of said sheet, adjacent to said aperture, sandwiched therebetween so as to support the article of manufacture by said sheet; and (c) inserting the article of manufacture into said aperture, by assembling said two components so as to be supported by said sheet, thereby preparing the article of manufacture to be displayed for sale.

13. A method of displaying two hand-held electronic devices being offered for sale, the method comprising the steps of:

(a) providing a substantially-rigid and planar sheet for supporting each of said two hand-held electronic devices within a respective aperture of said sheet;

(b) functionally configuring each of said two hand-held electronic devices to be supported by said sheet within said respective aperture thereof, wherein each of said two hand-held electronic devices includes two components that have at least a portion of said sheet, adjacent to said respective aperture, sandwiched therebetween so as to support a respective one of said two hand-held electronic devices by said sheet;

(c) for each of said two hand-held electronic devices, inserting said respective hand-held electronic device into said respective aperture of said sheet, by assembling said respective two components so as to be supported by said sheet; and (d) providing at least one perforation line in said sheet separating said two hand-held electronic devices, thereby preparing said two hand-held electronic devices to be displayed for sale.

* * * * *